US008595000B2

(12) United States Patent
Lee et al.

(10) Patent No.: US 8,595,000 B2
(45) Date of Patent: Nov. 26, 2013

(54) METHOD AND APPARATUS TO SEARCH FIXED CODEBOOK AND METHOD AND APPARATUS TO ENCODE/DECODE A SPEECH SIGNAL USING THE METHOD AND APPARATUS TO SEARCH FIXED CODEBOOK

(75) Inventors: Kangeun Lee, Gangneung-si (KR); Eunmi Oh, Seongnam-si (KR); Hosang Sung, Yongin-si (KR); Changyong Son, Gunpo-si (KR); Kihyun Choo, Seoul (KR); Junghoe Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 828 days.

(21) Appl. No.: 11/709,255

(22) Filed: Feb. 22, 2007

(65) Prior Publication Data

US 2007/0276655 A1 Nov. 29, 2007

(30) Foreign Application Priority Data

May 25, 2006 (KR) ..... 10-2006-0047118

(51) Int. Cl.
*G10L 19/00* (2013.01)
*G10L 19/12* (2013.01)
*G10L 21/00* (2013.01)

(52) U.S. Cl.
USPC ..... 704/219; 704/222; 704/223; 704/230

(58) Field of Classification Search
USPC ..... 704/219, 221, 223, 500
See application file for complete search history.

(56) References Cited

U.S. PATENT DOCUMENTS

| | | | | |
|---|---|---|---|---|
| 5,717,825 | A | 2/1998 | Lamblin | |
| 6,385,576 | B2 * | 5/2002 | Amada et al. | 704/223 |
| 6,996,522 | B2 * | 2/2006 | Chen | 704/219 |
| 7,272,555 | B2 * | 9/2007 | Lee et al. | 704/219 |
| 2002/0107686 | A1 | 8/2002 | Unno | |
| 2002/0133335 | A1 * | 9/2002 | Chen | 704/219 |
| 2003/0033136 | A1 * | 2/2003 | Lee | 704/2 |
| 2004/0017853 | A1 * | 1/2004 | Garrido et al. | 375/240.16 |
| 2004/0024594 | A1 | 2/2004 | Lee et al. | |
| 2004/0049381 | A1 * | 3/2004 | Kawahara | 704/219 |

(Continued)

FOREIGN PATENT DOCUMENTS

| | | |
|---|---|---|
| EP | 1496500 | 2/2007 |
| KR | 1020050007117 | 1/2005 |

OTHER PUBLICATIONS

Tsai et al, "A Bit Rate Scalable CELP Coding Method", Jun. 2004, Depoartment of Electrical Engineering, National Cheng Kung YUniversity, Taiwan, Master Thesis, pp. 1, 42-56.*

(Continued)

*Primary Examiner* — Richemond Dorvil
*Assistant Examiner* — Olujimi Adesanya
(74) *Attorney, Agent, or Firm* — Stanzione & Kim, LLP

(57) ABSTRACT

A method and an apparatus to encode and decode a speech signal using a code excited linear prediction (CELP) algorithm. In order to reduce a bit rate without degrading performance in an enhancement layer based on CELP, each of a fixed codebook of a core layer and a fixed codebook of the enhancement layer is divided into a plurality of spaces. The spaces of the fixed codebook of the enhancement layer excludes a space corresponding to a least distorted space determined from among the spaces of the fixed codebook of the core layer are searched.

34 Claims, 11 Drawing Sheets

(56) References Cited

U.S. PATENT DOCUMENTS

| | | | | |
|---|---|---|---|---|
| 2004/0181400 | A1* | 9/2004 | Kannan et al. | 704/223 |
| 2005/0010404 | A1 | 1/2005 | Son | |
| 2005/0114123 | A1* | 5/2005 | Lukac et al. | 704/222 |

OTHER PUBLICATIONS

Sung-Kyo Jung et al, "A bit-rate/bandwidth scalable speech coder based on ITU-T G.723.1 standard," Acoustics, Speech, and Signal Processing, 2004. Proceedings. (ICASSP '04). IEEE International Conference on , vol. 1, No. pp. I-285-8 vol. 1, May 17-21, 2004.*

Ramprashad, S.A.; , "High quality embedded wideband speech coding using an inherently layered coding paradigm," Acoustics, Speech, and Signal Processing, 2000. ICASSP '00. Proceedings. 2000 IEEE International Conference on , vol. 2, No. pp. II1145-II1148 vol. 2, 2000.*

Kataoka, A. "Scalable Wideband Speech Coding Using G.729 as a Component,", 2005, Systems and Computers in Japan, 36: 65-74.*

Chompun, "Fine Granularity Scalability for MPCELPbased Speech Coding with HPDR Technique", 2004, Proc. APCCAS-2004, pp. 197-200.*

Tsai et al, "Efficient algebraic code-excited linear predictive codebook search," Vision, Image and Signal Processing, IEE Proceedings—, vol. 153, No. 6, pp. 761-768, Dec. 2006.*

Tsai, "A Bit Rate Scalable CELP Coding Method", Jun. 2004, Master theseis, Department of Electrical Engineering, National Cheng Kung University, Full version , p. 1-93.*

International Search Report issued Aug. 17, 2007 in International Korean Application No. PCT/KR2007/002470.

Nomura , T. et al. 'A Bitrate and Bandwidth Scalable CELP Coder' In: Proceedings of the 1998 IEEE International Conference on Acoustics, Speech, and Signal Processing, 1998. IEEE, May 12-15, 1998, vol. 1, pp. 341-344.

Jbira, A. et al. 'Multi-Layer Scalable LPC Audio Format' In: Proceedings of the 2000 IEEE International Symposium on Circuits and Systems, 2000. Geneva, IEEE, May 28-31, 2000, vol. 3, pp. 209-212.

Extended European Search Report issued Aug. 2, 2011 in EP Application No. 07746618.3.

Chinese Office Action issued Apr. 20, 2011 in CN Application No. 200780019039.6.

A Bit Rate Scalable CELP Coding Method; Student: Hsing-Feng Tsai; Advisor: Chin-Hsing Chen Department of Electrical Engineering, National Cheng Kung University, Tainan Taiwan R.O.C., Thesis for Master of Science, Jun. 2004, pp. 9-27.

Korean Office Action Issued on Apr. 27, 2012 in KR Application No. 10-2006-0047118.

* cited by examiner

FIG. 8A

| offset | position bit | Sign bit | Position |
|---|---|---|---|
| 1 | 2 | 1 | 0,10,20,30 1,11,21,31 |
| | 2 | 1 | 2,12,22,32 3,13,23,33 |
| | 2 | 1 | 4,14,24,34 5,15,25,35 |
| | 3 | 1 | 6,16,26,36 7,17,27,37<br>8,18,28,38 9,19,29,39 |

FIG. 8B

| gain | position bit | Sign bit | Position |
|---|---|---|---|
| 3 | 2 | 1 | 0,10,20,30 1,11,21,31 |
| | 2 | 1 | 2,12,22,32 3,13,23,33 |
| | 2 | 1 | 4,14,24,34 5,15,25,35 |
| | 3 | 1 | 6,16,26,36 7,17,27,37<br>8,18,28,38 9,19,29,39 |

FIG. 8C

| position bit | Sign bit | Position |
|---|---|---|
| 3 | 1 | 0,5,10,15,20,25,30,35 |
| 3 | 1 | 1,6,11,16,21,26,31,36 |
| 3 | 1 | 2,7,12,17,22,27,32,37 |
| 4 | 1 | 3,8,13,18,23,28,33,38,<br>4,9,14,19,24,29,34,39 |

FIG. 8D

| gain | position bit | Sign bit | Position |
|---|---|---|---|
| 3 | 3 | 1 | 0,5,10,15,20,25,30,35 |
| | 3 | 1 | 1,6,11,16,21,26,31,36 |
| | 3 | 1 | 2,7,12,17,22,27,32,37 |
| | 4 | 1 | 3,8,13,18,23,28,33,38,<br>4,9,14,19,24,29,34,39 |

FIG. 9A

| offset | position bit | sign bit | Position | |
|---|---|---|---|---|
| 1 | 3 | 1 | 0, 8,16,24,32,40,48,56 | 1, 9,17,25,33,41,49,57 |
| | 3 | 1 | 2,10,18,26,34,42,50,58 | 3,11,19,27,35,43,51,59 |
| | 3 | 1 | 4,12,20,28,36,44,52,60 | 5,13,21,29,37,45,53,61 |
| | 3 | 1 | 6,14,22,30,38,46,54,62 | 7,15,23,31,39,47,55,63 |

FIG. 9B

| gain bit | position bit | sign bit | Position | |
|---|---|---|---|---|
| 3 | 3 | 1 | 0, 8,16,24,32,40,48,56 | 1, 9,17,25,33,41,49,57 |
| | 3 | 1 | 2,10,18,26,34,42,50,58 | 3,11,19,27,35,43,51,59 |
| | 3 | 1 | 4,12,20,28,36,44,52,60 | 5,13,21,29,37,45,53,61 |
| | 3 | 1 | 6,14,22,30,38,46,54,62 | 7,15,23,31,39,47,55,63 |

FIG. 9C

| position bit | sign bit | Position |
|---|---|---|
| 4 | 1 | 0,4,8,12,16,20,24,32,36,40,44,48,52,56,60 |
| 4 | 1 | 1,5,9,13,17,21,25,33,37,41,45,49,51,57,61 |
| 4 | 1 | 2,6,10,14,18,22,26,34,38,42,46,50,52,58,62 |
| 4 | 1 | 3,7,11,15,19,23,27,35,39,43,47,51,53,59,63 |

FIG. 9D

| gain bit | position bit | sign bit | Position |
|---|---|---|---|
| 3 | 4 | 1 | 0,4,8,12,16,20,24,32,36,40,44,48,52,56,60 |
| | 4 | 1 | 1,5,9,13,17,21,25,33,37,41,45,49,51,57,61 |
| | 4 | 1 | 2,6,10,14,18,22,26,34,38,42,46,50,52,58,62 |
| | 4 | 1 | 3,7,11,15,19,23,27,35,39,43,47,51,53,59,63 |

METHOD AND APPARATUS TO SEARCH FIXED CODEBOOK AND METHOD AND APPARATUS TO ENCODE/DECODE A SPEECH SIGNAL USING THE METHOD AND APPARATUS TO SEARCH FIXED CODEBOOK

CROSS-REFERENCE TO RELATED APPLICATIONS

This application claims the benefit of Korean Patent Application No. 10-2006-0047118, filed on May 25, 2006, in the Korean Intellectual Property Office, the disclosure of which is incorporated herein in its entirety by reference.

BACKGROUND OF THE INVENTION

1. Field of the Invention

The present general inventive concept relates to a method and apparatus to encode and decode a speech signal using a code excited linear prediction (CELP) algorithm. More specifically, the present general inventive concept relates to a method and apparatus to search a fixed codebook by which a bit rate is reduced without degrading performance in an enhancement layer based on the CELP.

2. Description of the Related Art

Speech codecs employing a CELP algorithm are widely used in mobile communication systems and are based on linear prediction coding (LPC).

These speech codecs that use the CELP algorithm encode a speech signal into a core layer including encoding information that can restore a minimal quality of sound and an enhancement layer including additional bits other than bits provided by the core layer to enhance the quality of restored sound. Accordingly, these speech codecs decode the encoded speech signal.

The core layer and the enhancement layer typically share spaces of an identical fixed codebook. Due to the space sharing, a number of codes to be represented increases, so that a bit rate increases.

SUMMARY OF THE INVENTION

The present general inventive concept provides a fixed codebook searching method and apparatus that reduces a bit rate without degrading performance in an enhancement layer based on CELP by dividing a fixed codebook of a core layer and a fixed codebook of an enhancement layer into a plurality of spaces, and searching spaces of the fixed codebook of the enhancement layer excluding a space corresponding to a least distorted space determined from among the spaces of the fixed codebook of the core layer. The present general inventive concept also provides a speech signal encoding/decoding method and apparatus using the fixed codebook searching method and apparatus.

Additional aspects of the present general inventive concept will be set forth in part in the description which follows and, in part, will be obvious from the description, or may be learned by practice of the general inventive concept.

The foregoing and/or other aspects of the present general inventive concept are achieved by providing an apparatus to encode a speech signal, the apparatus including a core layer codebook having a plurality of spaces into which combinations of possible positions of pulses are classified, a core layer generating unit to search each of the spaces of the core layer codebook and to generate a core layer by determining a least distorted space from among the spaces of the core layer codebook, an enhancement layer codebook having a plurality of spaces corresponding to the spaces of the core layer codebook, an enhancement layer generating unit to generate an enhancement layer by searching spaces of the enhancement layer codebook excluding a space that corresponds to the determined space in the core layer codebook, and an encoding unit to encode the speech signal into the core layer and the enhancement layer.

The foregoing and/or other aspects of the present general inventive concept are also achieved by providing an encoding apparatus to encode a speech signal, the apparatus including a core layer generation unit having a core fixed codebook with spaces that are searchable for codes to encode a core layer of the speech signal, and an enhancement layer generation unit having an enhancement fixed codebook with spaces that are searchable for codes to encode an enhancement layer of the speech signal, the searchable spaces of the enhancement fixed codebook being different from the searchable spaces of the core fixed codebook.

The foregoing and/or other aspects of the present general inventive concept are also achieved by providing an encoding apparatus to encode a speech signal, the apparatus including a core layer generation unit having a first fixed codebook with at least a first portion and a second portion, both the first and second portions being searchable to find a first fixed codebook vector that minimizes distortion with respect to a first signal, and an enhancement layer generation unit having a second fixed codebook with at least a first portion and a second portion corresponding to the first and second portions of the first fixed codebook, the first portion of the second fixed codebook being searchable for a second fixed codebook vector when the first fixed codebook vector is found in the second portion of the first fixed codebook, and the second portion of the second fixed codebook being searchable for the second fixed codebook vector when the first fixed codebook vector is found in the first portion of the first fixed codebook.

The foregoing and/or other aspects of the present general inventive concept are also achieved by providing an apparatus to decode a speech signal encoded into a core layer and an enhancement layer, the apparatus including a core layer codebook having a plurality of spaces into which combinations of possible positions of pulses are classified, a core layer decoding unit to decode the core layer by searching a space of the core layer codebook that is indicated by an identifier included in the encoded speech signal, an enhancement layer codebook having a plurality of spaces corresponding to the spaces of the core layer codebook, and an enhancement layer decoding unit to decode the enhancement layer by searching spaces of the enhancement layer codebook excluding a space that corresponds to the determined space of the core layer codebook.

The foregoing and/or other aspects of the present general inventive concept are also achieved by providing a fixed codebook searching method including searching each of spaces of a core layer codebook, determining a least distorted space from among the spaces of the core layer codebook, and searching spaces of an enhancement layer codebook excluding a space corresponding to the determined space of the core layer codebook, wherein the core layer codebook is configured by classifying possible pulse positions into a plurality of spaces, and the enhancement layer codebook is configured by classifying possible pulse positions into a plurality of spaces corresponding to the spaces of the core layer codebook.

The foregoing and/or other aspects of the present general inventive concept are also achieved by providing a decoding apparatus to decode an encoded speech signal, the apparatus including a core layer decoding unit having a core fixed codebook with spaces that are searchable for codes to decode a core layer of the encoded speech signal, and an enhancement layer decoding unit having an enhancement fixed codebook with spaces that are searchable for codes to decode an enhancement layer of the encoded speech signal, the searchable spaces of the enhancement fixed codebook being different from the searchable spaces of the core fixed codebook.

The foregoing and/or other aspects of the present general inventive concept are also achieved by providing a method of encoding a speech signal, the method including searching each of spaces of a core layer codebook, generating a core layer by determining a least distorted space from among the spaces of the core layer codebook, generating an enhancement layer by searching spaces of an enhancement layer codebook excluding a space corresponding to the determined space of the core layer codebook, and encoding the speech signal into the core layer and the enhancement layer, wherein the core layer codebook is configured by classifying possible pulse positions into a plurality of spaces, and the enhancement layer codebook is configured by classifying possible pulse positions into a plurality of spaces corresponding to the spaces of the core layer codebook.

The foregoing and/or other aspects of the present general inventive concept are also achieved by providing a method of searching a fixed codebook, the method including searching for a fixed codebook vector in first and second spaces of a fixed codebook of a core layer, comparing a distortion value of a first fixed codebook vector selected from the first space with a distortion value of a second fixed codebook vector selected from the second space, generating an identifier to indicate one of the first and second spaces based on the comparison of the distortion values, and searching another one of the first and second spaces not indicated by the identifier for a fixed codebook vector of an enhancement layer.

The foregoing and/or other aspects of the present general inventive concept are also achieved by providing a method of decoding a speech signal encoded into a core layer and an enhancement layer, the method including decoding the core layer by searching a space of a core layer codebook that is indicated by an identifier included in the encoded speech signal, and decoding the enhancement layer by searching spaces of an enhancement layer codebook excluding a space corresponding to the determined space of the core layer codebook, wherein the core layer codebook is configured by classifying possible pulse positions into a plurality of spaces, and the enhancement layer codebook is configured by classifying possible pulse positions into a plurality of spaces corresponding to the spaces of the core layer codebook.

BRIEF DESCRIPTION OF THE DRAWINGS

These and/or other aspects of the present general inventive concept will become apparent and more readily appreciated from the following description of the embodiments, taken in conjunction with the accompanying drawings of which:

FIG. 8A illustrates bits allocated to a fixed codebook of a core layer according to an embodiment of the present general inventive concept;

FIG. 8B illustrates bits allocated to a fixed codebook of an enhancement layer according to an embodiment of the present general inventive concept;

FIG. 8C illustrates bits allocated to a G.729 fixed codebook of a core layer;

FIG. 8D illustrates bits allocated to a G.729 fixed codebook of an enhancement layer;

FIG. 9A illustrates bits allocated to a fixed codebook of a core layer according to another embodiment of the present general inventive concept;

FIG. 9B illustrates bits allocated to a fixed codebook of an enhancement layer according to another embodiment of the present general inventive concept;

FIG. 9C illustrates bits allocated to a fixed codebook of a core layer in 3GPP2 VMR-WB rate set-1;

FIG. 9D illustrates bits allocated to a fixed codebook of an enhancement layer in 3GPP2 VMR-WB rate set-1;

DETAILED DESCRIPTION OF THE PREFERRED EMBODIMENTS

Figure 1:
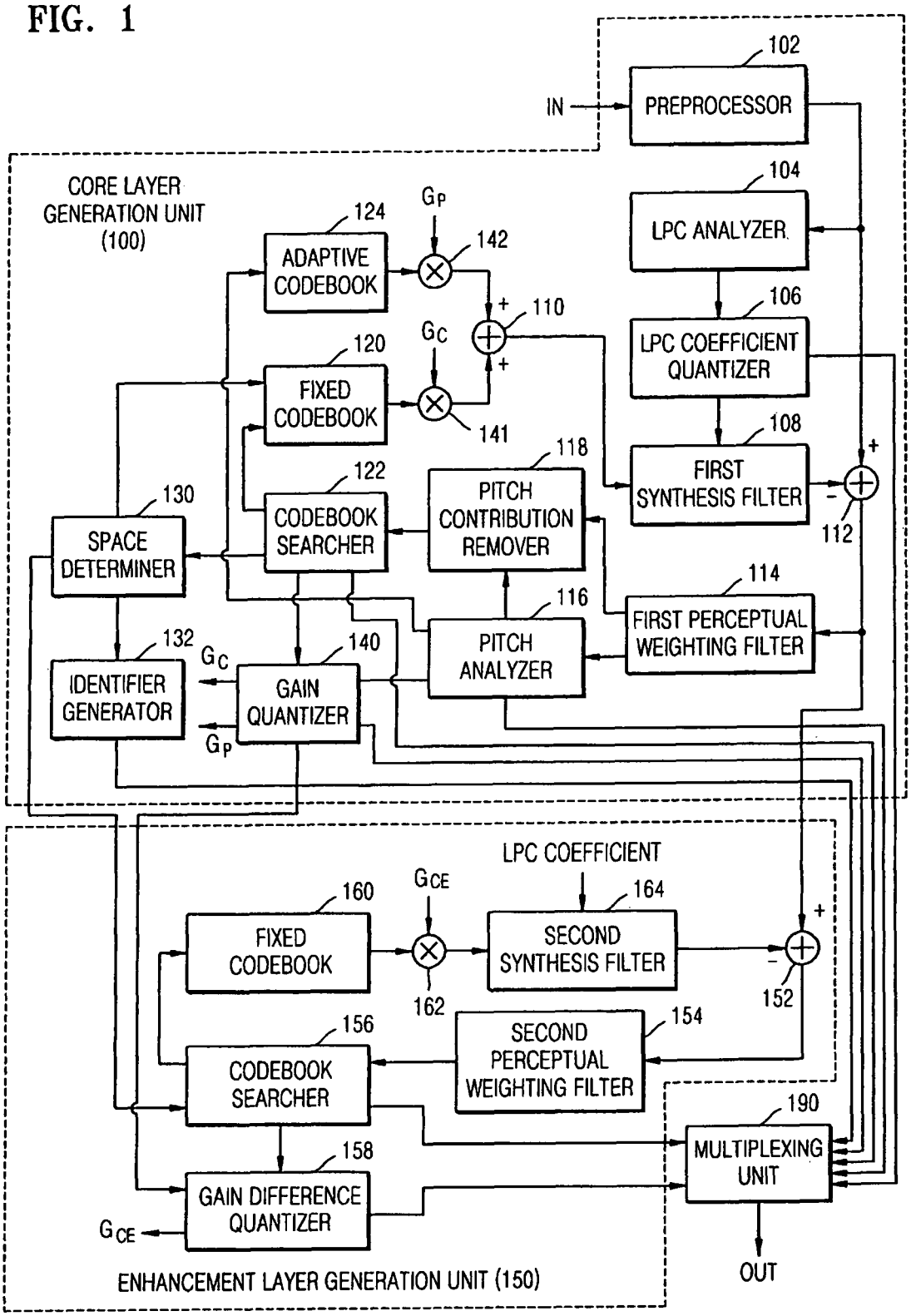
FIG. 1 is a block diagram illustrating an apparatus to encode a speech signal, according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a block diagram illustrating an apparatus to encode a speech signal, according to an embodiment of the present general inventive concept. The apparatus of FIG. 1 includes a core layer generation unit 100, an enhancement layer generation unit 150, and a multiplexing unit 190.

The core layer generation unit 100 generates a core layer that includes encoding information and restores a minimal quality of the speech signal. To achieve this, the core layer generation unit 100 filters an input speech signal using a linear prediction coding (LPC) method to produce an excitation signal corresponding to the speech signal.

The core layer generation unit 100 includes a preprocessor 102, an LPC analyzer 104, an LPC coefficient quantizer 106, a first synthesis filter 108, an adder 110, a first subtractor 112, a first perceptual weighting filter 114, a pitch analyzer 116, a pitch contribution remover 118, a fixed codebook 120, a codebook searcher 122, an adaptive codebook 124, a space determiner 130, an identifier generator 132, a gain quantizer 140, a first multiplier 141, and a second multiplier 142.

The preprocessor 102 removes a direct current (DC) component from a speech signal received via an input port IN. More specifically, the preprocessor 102 removes a noise component in a low frequency band by filtering the speech signal using a high pass filter included in the preprocessor 102.

The LPC analyzer 104 extracts an LPC coefficient from the speech signal from which the DC component has been removed by the preprocessor 102.

The LPC coefficient quantizer 106 vector-quantizes the LPC coefficient extracted by the LPC analyzer 104.

The first synthesis filter 108 generates a synthesized signal corresponding to an excited signal output by the adder 110, using the result of the vector quantization by the LPC coefficient quantizer 106.

The first subtractor 112 subtracts the synthesized signal output by the first synthesis filter 108 from the signal output by the speech signal output by the preprocessor 102.

The first perceptual weighting filter 114 filters the signal output by the first subtractor 112 so that the quantization noise of the signal becomes less than or equal to a masking threshold in order to utilize the masking effect of a human's hearing structure. The first perceptual weighting filter 114 generates a signal including a weight so as to minimize the quanitzation noise of the signal output by the first subtractor 112.

The pitch analyzer 116 divides the signal output by the first perceptual weighting filter 114 into a plurality of sub-frames and analyzes the pitch of each of the sub-frames so as to generate an index and a gain of the adaptive codebook 124.

The pitch contribution remover 118 detects a target signal needed to search for a fixed codebook vector corresponding to the signal output by the first perceptual weighting filter 114 from the fixed codebook 120, using the index of the adaptive codebook 124.

The fixed codebook 120 is configured by classifying combinations of possible pulse positions into a plurality of spaces.

Figure 6:
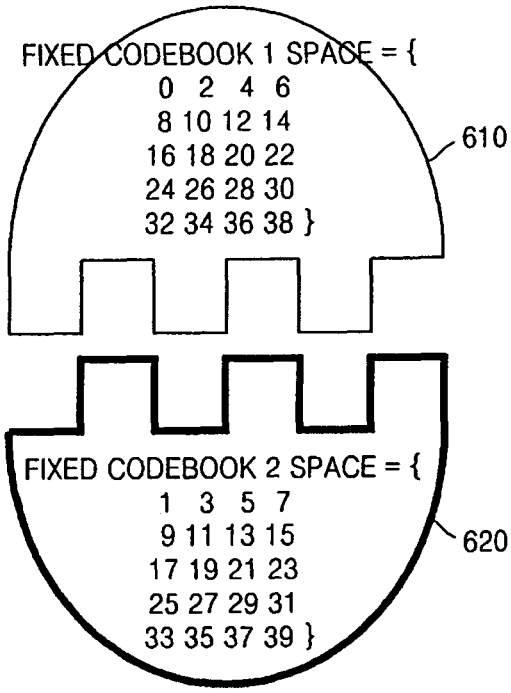
FIG. 6 is a conceptual diagram illustrating a fixed codebook of each of a core layer and an enhancement layer in which combinations of possible positions of pulses are classified into a first space and a second space.

As illustrated in FIG. 6, the fixed codebook 120 may be configured by classifying combinations of possible pulse positions into a first space 610 and a second space 620. The first space 610 may include the possible positions of pulses that are highly likely to be searched for in a core layer.

Figure 7A:
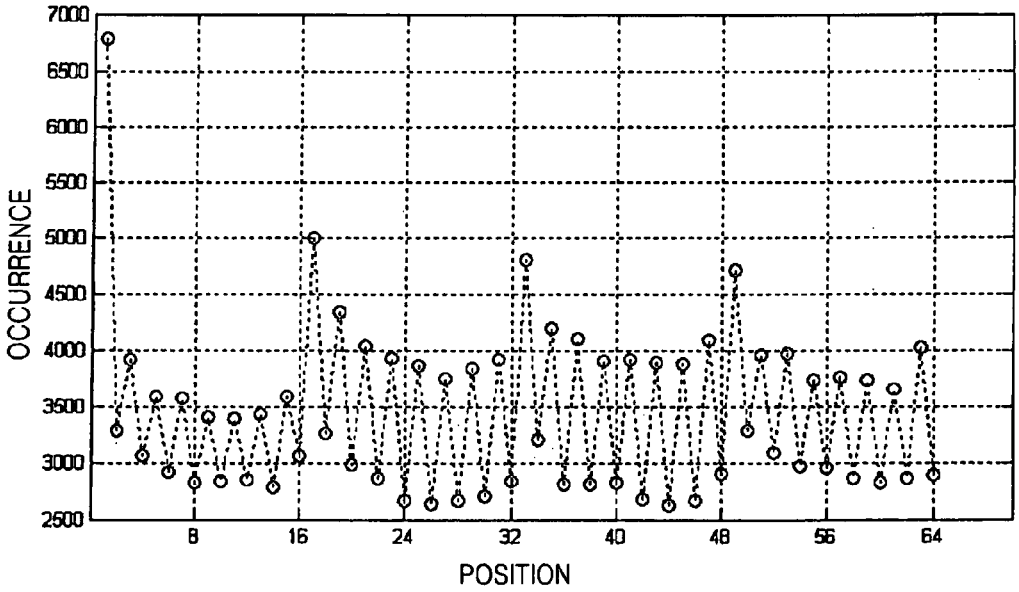
FIG. 7A is a graph illustrating a probability that a position of each pulse is selected from the fixed codebook of the enhancement layer, when a pulse position value found in the fixed codebook of the core layer is even-numbered.
Figure 7B:
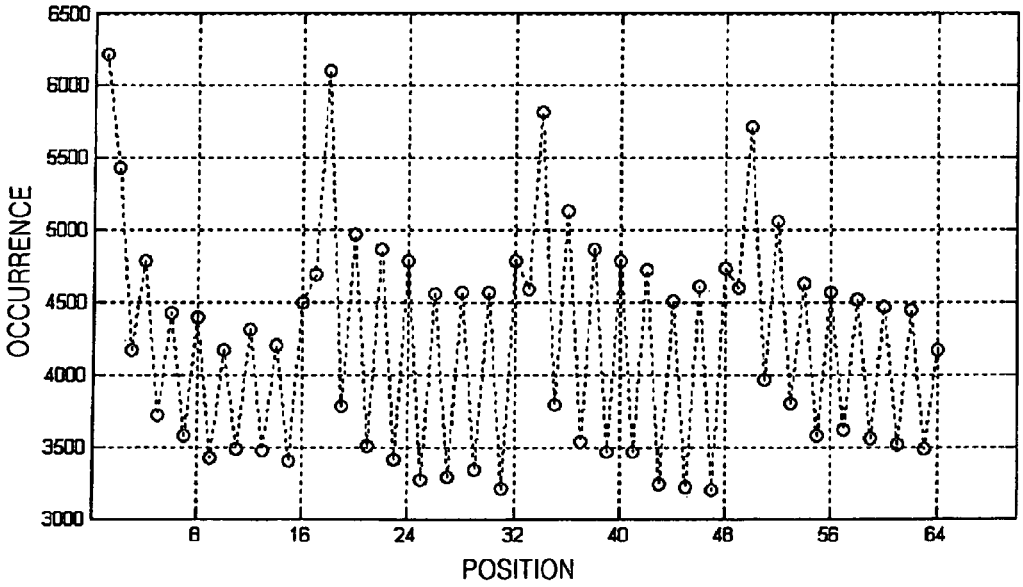
FIG. 7B is a graph illustrating a probability that a position of each pulse is selected from the fixed codebook of the enhancement layer, when a pulse position value found in the fixed codebook of the core layer is odd-numbered.

The first and second spaces 610 and 620 may be distinguished from each other according to whether possible pulse positions are even or odd. FIG. 7A is a graph illustrating a probability that the position of each pulse is selected from a fixed codebook of an enhancement layer, when a pulse position value found in the fixed codebook of a core layer is even. Referring to FIG. 7A, when a pulse position value found in the fixed codebook of the core layer is even, the probability that a pulse position value corresponding to an odd number is selected from the fixed codebook of the enhancement layer is significantly high. FIG. 7B is a graph illustrating a probability that the position of each pulse is selected from the fixed codebook of the enhancement layer, when a pulse position value found in the fixed codebook of the core layer is odd. Referring to FIG. 7B, when a pulse position value found in the fixed codebook of the core layer is odd, the probability that a pulse position value corresponding to an even number is selected from the fixed codebook of the enhancement layer is significantly high. Hence, each of the codebooks of the core layer and the enhancement layer may be configured by classifying odd-numbered possible pulse positions into a first space and even-numbered possible pulse positions into a second space. Alternatively, as illustrated in FIG. 6, each of the codebooks of the core layer and the enhancement layer may be configured by classifying the even-numbered possible pulse positions into the first space 610 and the odd-numbered possible pulse positions into the second space 620.

Referring back to FIG. 1, the fixed codebook 120 outputs a fixed codebook vector using an index found by the codebook searcher 122.

The codebook searcher 122 searches the fixed codebook 120 for a fixed codebook vector corresponding to the target signal detected by the pitch contribution remover 118 and outputs an index and a gain of the fixed codebook 120. More specifically, the codebook searcher 122 searches for a fixed codebook vector that minimizes a mean square error (MSE) of the target signal.

When the codebook searcher 122 searches for the fixed codebook vector, a plurality of spaces included in the fixed codebook 120 are each searched. If the fixed codebook 120 is divided into the first and second spaces 610 and 620 (See FIG. 6), the first space 610 is searched for a fixed codebook vector that minimizes the MSE of the target signal, and the second space 620 is also searched for a fixed codebook vector that minimizes the MSE of the target signal.

The space determiner 130 detects a least distorted fixed codebook vector from the fixed codebook vectors found in all of the spaces of the fixed codebook 120 by the codebook searcher 122 and outputs the space to which the detected fixed codebook vector belongs.

The identifier generator 132 generates an identifier indicating the space determined by the space determiner 130. For example, a bit "offset" illustrated in FIGS. 8A and 9A corresponds to the identifier of the space output by the space determiner 130.

The adaptive codebook 124 outputs an adaptive codebook vector corresponding to the index output by the pitch analyzer 116.

The gain quantizer 140 quantizes the gain of the fixed codebook 120 output by the codebook searcher 122 and the gain of the adaptive codebook 124 output by the pitch analyzer 116 and outputs the results of the quantizations. The gain quantizer 140 outputs a quantized gain Gc of the fixed codebook 120 to the first multiplier 141 and a quantized gain Gp of the adaptive codebook 124 to the second multiplier 142.

The first multiplier 141 multiplies the fixed codebook vector output by the fixed codebook 120 by the quantized gain Gc of the fixed codebook 120 received from the gain quantizer 140.

The second multiplier 142 multiplies the adaptive codebook vector output by the adaptive codebook 124 by the quantized gain Gp of the adaptive codebook 124 received from the gain quantizer 140.

The adder 110 adds the product received from the first multiplier 141 to the product received from the second multiplier 142.

The enhancement layer generation unit 150 generates an enhancement layer to serve as an additional bit other than a bit provided by the core layer generation unit 100 in order to enhance the restored quality of sound. For example, when the core layer provides a bit rate of 8 kbps, the enhancement layer may provide an additional bit rate of 4 kbps.

The enhancement layer generation unit 150 includes a second subtractor 152, a second perceptual weighting filter 154, a codebook searcher 156, a gain difference quantizer 158, a fixed codebook 160, a third multiplier 162, and a second synthesis filter 164.

The second subtractor 152 subtracts a result output by the second perceptual weighting filter 154 from a result output by the first subtractor 112.

The second perceptual weighting filter 154 performs a filtering operation so that quantization noise is less than or equal to a masking threshold in order to utilize the masking effect of a human's hearing structure. More specifically, the second perceptual weighting filter 154 produces a signal including a weight in order to minimize the quantization noise of the signal output by the second subtractor 152.

The fixed codebook 160 outputs a fixed codebook vector corresponding to an index obtained by the codebook searcher 156. The fixed codebook 160 of the enhancement layer generation unit 150 is divided into a plurality of spaces corresponding to the spaces (i.e., the first and second spaces 610 and 620 of FIG. 6) of the fixed codebook 120 of the core layer generating unit 100.

The codebook searcher 156 searches the fixed codebook 160 for a fixed codebook vector corresponding to the result of the filtering by the second perceptual weighting filter 154 and outputs an index and a gain of the fixed codebook 160.

When the codebook searcher 156 searches for the fixed codebook vector, spaces of the fixed codebook 160 excluding the space determined by the space determiner 130 of the core layer generation unit 100 are each searched. Accordingly, if each of the fixed codebooks 120 and 160 of the core layer generating unit 100 and the enhancement layer generation unit 150, respectively, is divided into the first and second spaces 610 and 620 (See FIG. 6), and the first space 610 is determined by the space determiner 130, the codebook searcher 156 of the enhancement layer generation unit 150 searches the second space 620 for the fixed codebook vector. If the second space 620 is determined by the space determiner 130 of the core layer generation unit 100, the codebook searcher 156 of the enhancement layer generation unit 150 searches the first space 610 for the fixed codebook vector.

The gain difference quantizer 158 obtains a difference between the gain of the fixed codebook 160 output by the codebook searcher 156 of the enhancement layer generation unit 150 and the quantized gain Gc of the fixed codebook 120 output by the gain quantizer 140 of the core layer generation unit 100 and quantizes the difference. The gain difference quantizer 158 outputs the quantized gain difference Gce to the third multiplier 162 and the multiplexing unit 190.

The third multiplier 162 multiplies the fixed codebook vector output by the fixed codebook 160 of the enhancement layer generation unit 150 by the quantized gain difference Gce received from the gain difference quantizer 158.

The second synthesis filter 164 generates a synthesized signal corresponding to the product output by the third multiplier 162, using the result of the vector quantization by the LPC coefficient quantizer 106.

The multiplexing unit 190 generates a bitstream from the outputs of the LPC coefficient quantizer 106, the pitch analyzer 116, the codebook searcher 122, the identifier generator 132, the gain quantizer 140, the codebook searcher 156, and the gain difference quantizer 158. The multiplexing unit 190 then outputs the bitstream via an output port OUT.

Figure 2:
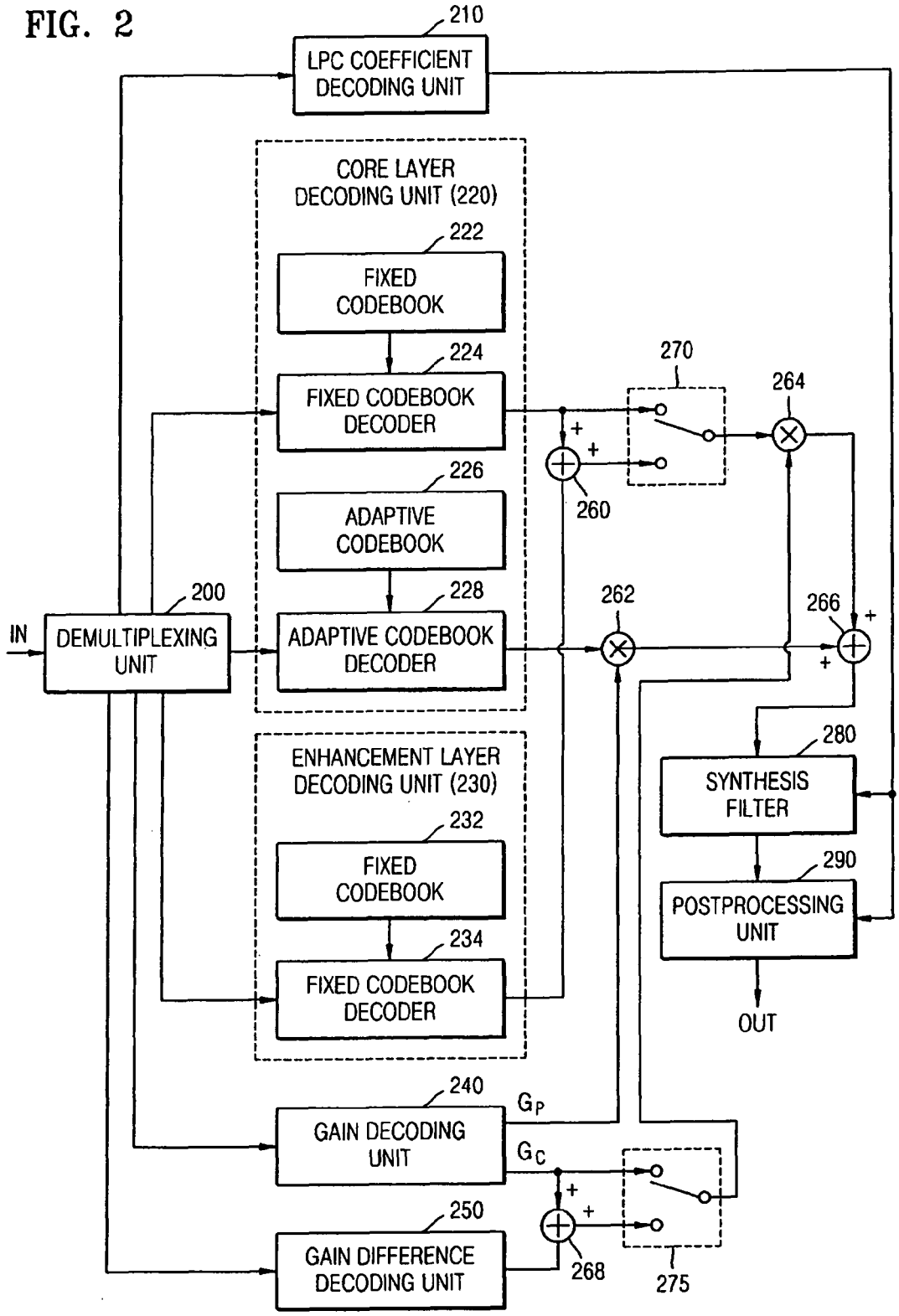
FIG. 2 is a block diagram illustrating an apparatus to decode a speech signal, according to an embodiment of the present general inventive concept.

FIG. 2 is a block diagram illustrating an apparatus to decode a speech signal, according to an embodiment of the present general inventive concept. The apparatus of FIG. 2 includes a demultiplexing unit 200, an LPC coefficient decoding unit 210, a core layer decoding unit 220, an enhancement layer decoding unit 230, a gain decoding unit 240, a gain difference decoding unit 250, a first adder 260, a first multiplier 262, a second multiplier 264, a second adder 266, a third adder 268, a first switching unit 270, a second switching unit 275, a synthesis filter 280, and a postprocessing unit 290.

The demultiplexing unit 200 receives a bitstream via an input port IN and analyzes the bitstream. The demultiplexing unit 200 outputs LPC coefficient quantization information to the LPC coefficient decoding unit 210, an index and identifier of a fixed codebook 222 to a fixed codebook decoder 224, an index of an adaptive codebook 226 to an adaptive codebook decoder 228, an index and identifier of a fixed codebook 232 to a fixed codebook decoder 234, gain quantization information to the gain decoding unit 240, and gain difference quantization information to the gain difference decoding unit 250.

The LPC coefficient decoding unit 210 decodes an LPC coefficient using the LPC coefficient quantization information received from the demultiplexing unit 200.

The core layer decoding unit 220 decodes a core layer. The core layer decoding unit 220 includes the fixed codebook 222, the fixed codebook decoder 224, the adaptive codebook 226, and the adaptive codebook decoder 228.

The fixed codebook 222 of the core layer decoding unit 220 is configured by classifying combinations of possible pulse positions into a plurality of spaces, as in the fixed codebooks 120 and 160 of the core layer generation unit 100 and the enhancement layer generation unit 150 of FIG. 1.

The fixed codebook 222 may be configured by classifying combinations of possible pulse positions into the first spaces 610 and 620, as illustrated in FIG. 6. The first space 610 may include the possible positions of pulses that are highly likely to be searched for in the core layer.

The first and second spaces 610 and 620 may be distinguished from each other according to whether the possible pulse positions are even or odd. FIG. 7A is a graph illustrating a probability that the position of each pulse is selected from a fixed codebook of an enhancement layer, when a pulse position value found in the fixed codebook of a core layer is even. Referring to FIG. 7A, when a pulse position value found in the fixed codebook of the core layer is even, the probability that a pulse position value corresponding to an odd number is selected from the fixed codebook of the enhancement layer is significantly high. FIG. 7B is a graph illustrating a probability that the position of each pulse is selected from the fixed codebook of the enhancement layer, when a pulse position value found in the fixed codebook of the core layer is odd. Referring to FIG. 7B, when a pulse position value found in the fixed codebook of the core layer is odd, the probability that a pulse position value corresponding to an even number is selected from the fixed codebook of the enhancement layer is significantly high. Hence, each of the codebooks of the core layer and the enhancement layer may be configured by classifying odd-numbered possible pulse positions into a first space and even-numbered possible pulse positions into a second space. Alternatively, as illustrated in FIG. 6, each of the codebooks of the core layer and the enhancement layer may be configured by classifying the even-numbered possible pulse positions into the first space 610 and the odd-numbered possible pulse positions into the second space 620.

Referring back to FIG. 2, the fixed codebook decoder 224 determines a to-be-searched space of the spaces of the fixed codebook 222 using the identifier output by the demultiplexing unit 200, searches the determined space for a codeword corresponding to the index output by the demultiplexing unit 200, and decodes the codeword. Here, the identifier represents a bit "offset" illustrated in FIGS. 8A and 9A.

The adaptive codebook decoder 228 searches the adaptive codebook 226 for the codeword corresponding to the index output by the demultiplexing unit 200 and decodes the codeword.

The enhancement layer decoding unit 230 decodes an enhancement layer. The enhancement layer decoding unit 230 includes the fixed codebook 232 and the fixed codebook decoder 234.

The fixed codebook 232 is divided into a plurality of spaces corresponding to the spaces of the fixed codebook 222 of the core layer decoding unit 220.

The fixed codebook decoder 234 searches spaces of the fixed codebook 232 excluding the space determined by the fixed codebook decoder 224 of the core layer decoding unit 220 for a codeword corresponding to the index output by the demultiplexing unit 200 and decodes the found codeword. Accordingly, if each of the fixed codebooks 222 and 232 of the core layer decoding unit 220 and the enhancement layer decoding unit 230, respectively, is divided into the first and second spaces 610 and 620, and the first space 610 is determined by the fixed codebook decoder 224, the fixed codebook decoder 234 searches the second space 620 for the codeword. If the second space 620 is determined by the fixed codebook decoder 224, the fixed codebook decoder 234 searches the first space 610 for the codeword.

The gain decoding unit 240 decodes the gain quantization information received from the demultiplexing unit 200, the information including a fixed codebook gain Gc and an adaptive codebook gain Gp of the core layer, and outputs the fixed codebook gain Gc and the adaptive codebook gain Gp.

The gain difference decoding unit 250 decodes a difference between the gains of the fixed codebooks of the core layer and the enhancement layer output by the demultiplexing unit 200.

The first adder 260 adds a result output by the fixed codebook decoder 224 of the core layer decoding unit 220 to a result output by the fixed codebook decoder 234 of the enhancement layer decoding unit 230.

The first switching unit 270 selectively switches between the result output by the fixed codebook decoder 224 or a result of the addition by the first adder 260 according to a control signal.

The third adder 268 adds the fixed codebook gain Gc of the core layer output by the gain decoding unit 240 to a result output by the gain difference decoding unit 250.

The second switching unit 275 selectively switches between the fixed codebook gain Gc of the core layer output by the gain decoding unit 240 or the result of the addition by the third adder 268 according to a control signal.

The second multiplier 264 multiplies the result output by the first switching unit 270 by the result output by the second switching unit 275.

The first multiplier 262 multiplies the result of the decoding by the adaptive codebook decoder 228 by the adaptive codebook gain Gp output by the gain decoding unit 240.

The second adder 266 adds the result of the multiplication by the first multiplier 262 to the result of the multiplication by the second multiplier 264.

The synthesis filter 280 synthesizes the result of the addition by the second adder 266 using the decoded LPC coefficient received from the LPC coefficient decoding unit 210, to thereby restore the speech signal.

The postprocessing unit 290 improves the quality of the speech signal restored by the synthesis filter 280 and outputs the improved speech signal via an output port OUT. More specifically, the postprocessing unit 290 filters the restored speech signal using a high pass filter and the decoded LPC coefficient output by the LPC coefficient decoding unit 210, in order to improve the quality of the speech signal restored by the synthesis filter 280.

A codebook searching apparatus according to embodiments of the present general inventive concept is included in the speech signal encoding apparatus of FIG. 1 and the speech signal decoding apparatus of FIG. 2.

Figure 3:
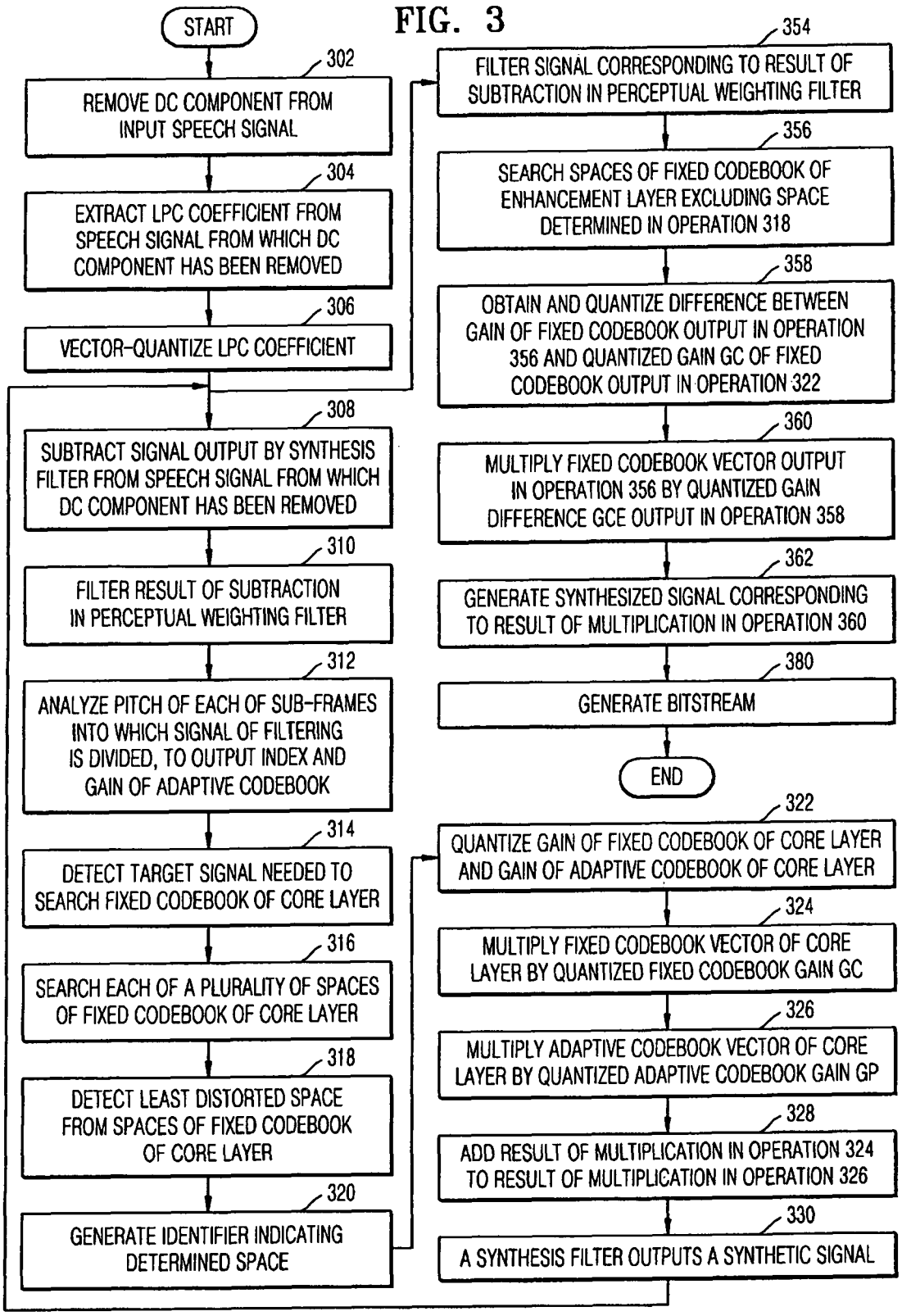
FIG. 3 is a flowchart illustrating a method of encoding a speech signal, according to an embodiment of the present general inventive concept.

FIG. 3 is a flowchart illustrating a method of encoding a speech signal, according to an embodiment of the present general inventive concept. The method of FIG. 3 may be performed by the encoding apparatus of FIG. 1. First, in operation 302, a DC component is removed from an input speech signal. That is, in the operation 302, the speech signal is filtered using a high pass filter to remove a noise component in a low frequency band from the speech signal.

In operation 304, an LPC coefficient is extracted from the speech signal from which the DC component has been removed in the operation 302.

In operation 306, the LPC coefficient extracted in the operation 304 is vector quantized.

In operation 308, a subtractor subtracts a signal output by a synthesis filter of a core layer from the speech signal from which the DC component has been removed.

In operation 310, in order to use the masking effect of a human's hearing structure, a perceptual weighting filter of the core layer filters the result of the subtraction in the operation 308 so that quantization noise become less than or equal to a masking threshold. In the operation 310, a signal including a weight is generated so as to minimize the quantization noise of the signal output in the operation 308.

In operation 312, the signal filtered in the operation 310 is divided into a plurality of sub-frames, and the pitch of each of the sub-frames is analyzed to output an index and gain of an adaptive codebook.

In operation 314, a target signal needed to search a fixed codebook for a fixed codebook vector corresponding to the signal filtered in the operation 310 is detected using the index of the adaptive codebook output in the operation 312.

In operation 316, the fixed codebook is searched for a fixed codebook vector corresponding to the target signal detected in the operation 314. In the operation 316, a fixed codebook vector that minimizes a mean squared error (MSE) of the target signal is searched for.

The fixed codebook of the core layer is configured by classifying combinations of possible pulse positions into a plurality of spaces.

As illustrated in FIG. 6, the fixed codebook of the core layer may be configured by classifying combinations of possible pulse positions into the first space 610 and the second space 620. The first space 610 may include the possible positions of pulses that are highly likely to be searched for in a core layer.

The first and second spaces 610 and 620 may be distinguished from each other according to whether possible pulse positions are even or odd. FIG. 7A is a graph illustrating a probability that the position of each pulse is selected from a fixed codebook of an enhancement layer, when a pulse position value found in the fixed codebook of a core layer is even. Referring to FIG. 7A, when a pulse position value found in the fixed codebook of the core layer is even, the probability that a pulse position value corresponding to an odd number is selected from the fixed codebook of the enhancement layer is significantly high. FIG. 7B is a graph illustrating a probability that the position of each pulse is selected from the fixed codebook of the enhancement layer, when a pulse position value found in the fixed codebook of the core layer is odd.

Referring to FIG. 7B, when a pulse position value found in the fixed codebook of the core layer is odd, the probability that a pulse position value corresponding to an even number is selected from the fixed codebook of the enhancement layer is significantly high. Hence, each of the codebooks of the core layer and the enhancement layer may be configured by classifying odd-numbered possible pulse positions into a first space and even-numbered possible pulse positions into a second space. Alternatively, as illustrated in FIG. 6, each of the codebooks of the core layer and the enhancement layer may be configured by classifying the even-numbered possible pulse positions into the first space 610 and the odd-numbered possible pulse positions into the second space 620.

Referring back to FIG. 3, the fixed codebook search in the operation 316, each of the spaces of the fixed codebook of the core layer is searched. Accordingly, if the fixed codebook is divided into the first and second spaces 610 and 620 (See FIG. 6), the first space 610 is searched for a fixed codebook vector that minimizes the MSE of the target signal, and the second space 620 is also searched for the fixed codebook vector that minimizes the MSE of the target signal.

In operation 318, the least distorted fixed codebook vector is detected from the fixed codebook vectors found in the spaces of the fixed codebook of the core layer, and the space from which the detected fixed codebook vector is found is output. In the operation 318, an index and gain of the fixed codebook belonging to the determined space are output.

In operation 320, an identifier indicating the space determined in the operation 318 is generated. For example, the bit "offset" illustrated in FIGS. 8A and 9A corresponds to the identifier of the space determined in the operation 318.

In operation 322, the gain of the fixed codebook output in the operation 318 and the gain of the adaptive codebook output in operation 312 are quantized to generate a quantized fixed codebook gain Gc and a quantized adaptive codebook gain Gp.

In operation 324, the fixed codebook vector detected in the operation 318 is multiplied by the quantized fixed codebook gain Gc generated in the operation 322.

In operation 326, the adaptive codebook vector detected in the operation 312 is multiplied by the quantized adaptive codebook gain Gp generated in the operation 322.

In operation 328, the result of the multiplication in the operation 324 is added to the result of the multiplication in the operation 326.

In operation 330, a synthesis filter outputs a synthetic signal corresponding to an excitation signal obtained in the operation 328, using the result of the vector quantization in operation 306.

After the operation 308, a signal corresponding to the result of the subtraction in the operation 308 is filtered so that quantization noise of the signal becomes less than or equal to a masking threshold, in order to utilize the masking effect of the human's hearing structure, in operation 354. In other words, in the operation 354, a signal including a weight is generated so as to minimize the quantization noise of the signal obtained in the operation 308.

In operation 356, a fixed codebook vector corresponding to the result of the filtering in the operation 354 is searched for in the fixed codebook. In the operation 356, an index and a gain of the fixed codebook vector found in the operation 356 are output.

The fixed codebook of the enhancement layer is divided into a plurality of spaces corresponding to the spaces of the fixed codebook of the core layer.

Upon the fixed codebook vector search in the operation 354, spaces of the fixed codebook of the enhancement layer excluding the space determined in the operation 318 are each searched. Accordingly, if each of the fixed codebooks of the core layer and the enhancement layer is divided into the first and second spaces 610 and 620 (See FIG. 6), and the first space 610 is determined in the operation 318, the second space 620 is searched for a fixed codebook vector in the operation 356. If the second space 620 is determined in the operation 318, the first space 610 is searched for a fixed codebook vector in the operation 356.

In operation 358, a difference between the gain of the fixed codebook output in the operation 356 and the quantized gain Gc of the fixed codebook output in the operation 322 is obtained and quantized to generate a quantized gain difference Gce.

In operation 360, the fixed codebook vector output in the operation 356 is multiplied by the quantized gain difference Gce output in the operation 358.

In operation 362, a synthesis filter generates a synthesized signal corresponding to the result of the multiplication in the operation 360, using the result of the vector quantization in the operation 306.

In operation 380, a bitstream is generated from the results output in the operations 306, 312, 318, 320, 322, 356, and 358.

Figure 4:
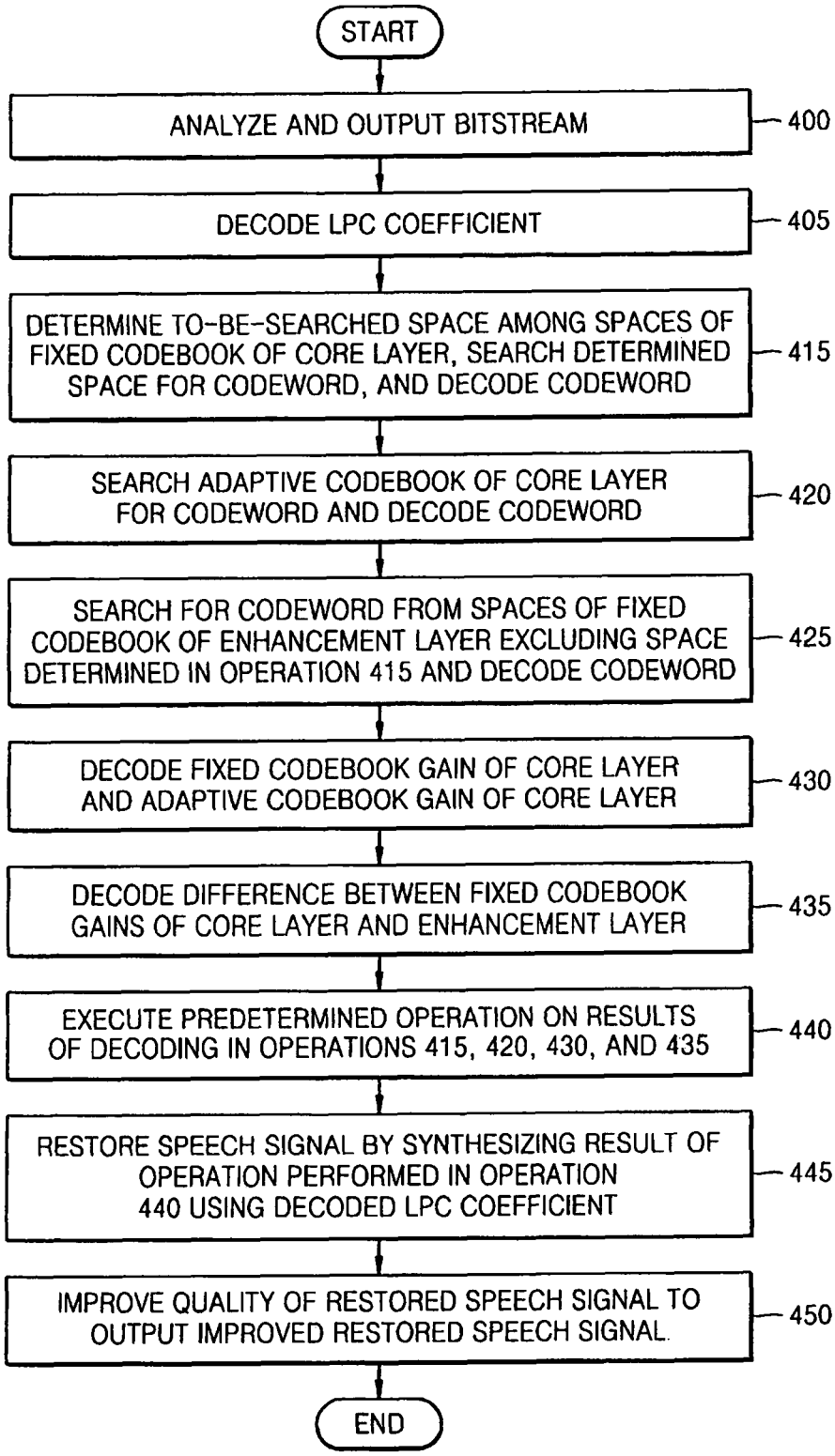
FIG. 4 is a flowchart illustrating a method of decoding a speech signal, according to an embodiment of the present general inventive concept.

FIG. 4 is a flowchart illustrating a method of decoding a speech signal, according to an embodiment of the present general inventive concept. The method of FIG. 4 may be performed by the decoding apparatus of FIG. 2. First, in operation 400, a bitstream is received from a speech signal encoding apparatus, and the bitstream is analyzed. More specifically, in the operation 400, LPC coefficient quantization information, an index and an identifier of a fixed codebook of a core layer, an index of an adaptive codebook of the core layer, an index and identifier of a fixed codebook of an enhancement layer, gain quantization information, and gain difference quantization information are output.

In operation 405, an LPC coefficient is decoded using the LPC coefficient quantization information output in the operation 400.

In operation 415, a to-be-searched space of the spaces of the fixed codebook of the core layer is determined using the identifier output in the operation 400, the determined space is searched for a codeword corresponding to the index output in the operation 400, and the codeword is decoded. Here, the identifier represents a specific space provided in the fixed codebook of the core layer as a bit "offset" illustrated in FIGS. 8A and 9A.

The fixed codebook of the core layer is configured by classifying combinations of possible pulse positions into a plurality of spaces, as in the fixed codebook of the enhancement layer.

The fixed codebook of the core layer may be configured by classifying combinations of possible pulse positions into the first spaces 610 and 620, as illustrated in FIG. 6. The first space 610 may include the possible positions of pulses that are highly likely to be searched for in the core layer.

The first and second spaces 610 and 620 may be distinguished from each other according to whether possible pulse positions are even or odd. FIG. 7A is a graph illustrating a probability that the position of each pulse is selected from a fixed codebook of an enhancement layer, when a pulse position value found in the fixed codebook of a core layer is even. Referring to FIG. 7A, when a pulse position value found in the fixed codebook of the core layer is even, the probability that a pulse position value corresponding to an odd number is selected from the fixed codebook of the enhancement layer is significantly high. FIG. 7B is a graph illustrating a probability that the position of each pulse is selected from the fixed codebook of the enhancement layer, when a pulse position value found in the fixed codebook of the core layer is odd. Referring to FIG. 7B, when a pulse position value found in the fixed codebook of the core layer is odd, the probability that a pulse position value corresponding to an even number is selected from the fixed codebook of the enhancement layer is significantly high. Hence, each of the codebooks of the core layer and the enhancement layer may be configured by classifying odd-numbered possible pulse positions into a first space and even-numbered possible pulse positions into a second space. Alternatively, as illustrated in FIG. 6, each of the codebooks of the core layer and the enhancement layer may be configured by classifying the even-numbered possible pulse positions into the first space 610 and the odd-numbered possible pulse positions into the second space 620.

Referring back to FIG. 4, in operation 420, the codeword corresponding to the index of the adaptive codebook of the core layer output in the operation 400 is searched for from the adaptive codebook of the core layer and is decoded.

In operation 425, a codeword corresponding to the index of the fixed codebook of the enhancement layer output in the operation 400 is searched for in spaces of the fixed codebook of the enhancement layer excluding the space determined in the operation 415 and is decoded. Accordingly, if each of the fixed codebooks of the core layer and the enhancement layer is divided into the first and second spaces 610 and 620 (See FIG. 6), and the first space 610 is determined in the operation 415, a codeword is searched for in the second space 620. If the second space 620 is determined in the operation 415, a codeword is searched for in the first space 610.

The fixed codebook of the enhancement layer is configured by classifying combinations of possible pulse positions into spaces corresponding to the spaces of the fixed codebook of the core layer.

In operation 430, the fixed codebook gain and the adaptive codebook gain output in the operation 400 are decoded.

In operation 435, a difference between the fixed codebook gains of the core layer and the enhancement layer output in the operation 400 is decoded.

In operation 440, a predetermined operation is executed on the results of the decoding in the operations 415, 420, 430, and 435.

In operation 445, the result of the operation performed in the operation 440 is synthesized in a synthesis filter using the decoded LPC coefficient output in the operation 405, to thereby restore the speech signal.

In the operation 450, the quality of the speech signal restored in the operation 445 is improved to thereby output an improved restored speech signal. More specifically, in the operation 450, the quality of the speech signal restored in the operation 445 is improved by filtering the restored speech signal using a high pass filter and the decoded LPC coefficient output in the operation 405.

A codebook searching method according to embodiments of the present general inventive concept is performed during the speech signal encoding method of FIG. 3 and the speech signal decoding method of FIG. 4.

Figure 5:
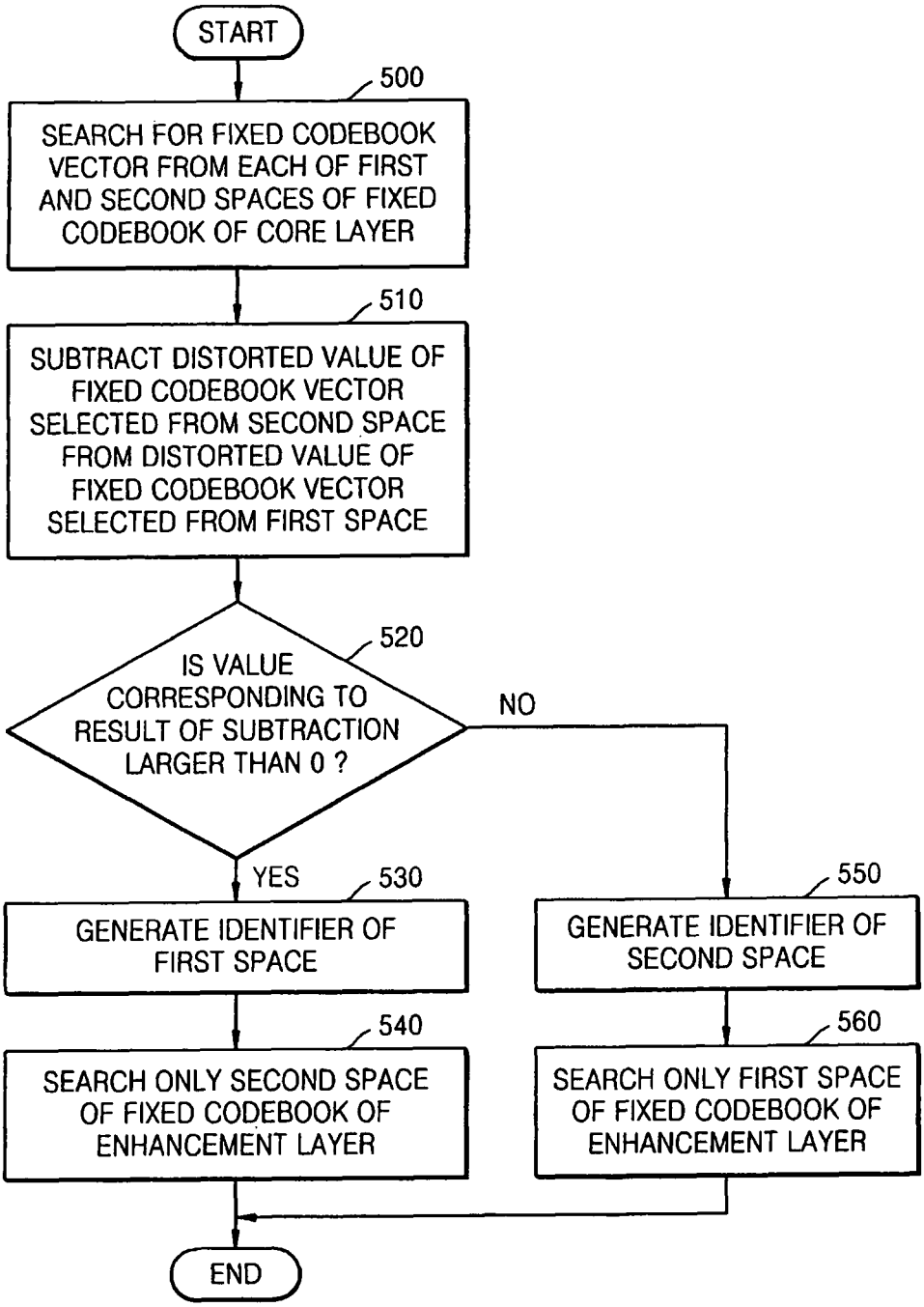
FIG. 5 is a flowchart illustrating a method of searching for a fixed codebook, according to an embodiment of the present general inventive concept.

FIG. 5 is a flowchart illustrating a method of searching for a fixed codebook, according to an embodiment of the present general inventive concept. Each of the fixed codebooks of the core layer and the enhancement layer may be configured by classifying combinations of possible pulse positions into the first and second spaces 610 and 620 (See FIG. 6).

The first space 610 may include the possible positions of pulses that are highly likely to be searched for in a core layer.

The first and second spaces 610 and 620 may be distinguished from each other according to whether possible pulse positions are even or odd. FIG. 7A is a graph illustrating a probability that the position of each pulse is selected from a fixed codebook of an enhancement layer, when a pulse position value found in the fixed codebook of a core layer is even. Referring to FIG. 7A, when a pulse position value found in the fixed codebook of the core layer is even, the probability that a pulse position value corresponding to an odd number is selected from the fixed codebook of the enhancement layer is significantly high. FIG. 7B is a graph illustrating a probability that the position of each pulse is selected from the fixed codebook of the enhancement layer, when a pulse position value found in the fixed codebook of the core layer is odd. Referring to FIG. 7B, when a pulse position value found in the fixed codebook of the core layer is odd, the probability that a pulse position value corresponding to an even number is selected from the fixed codebook of the enhancement layer is significantly high. Hence, each of the codebooks of the core layer and the enhancement layer may be configured by classifying odd-numbered possible pulse positions into a first space and even-numbered possible pulse positions into a second space. Alternatively, as illustrated in FIG. 6, each of the codebooks of the core layer and the enhancement layer may be configured by classifying the even-numbered possible pulse positions into the first space 610 and the odd-numbered possible pulse positions into the second space 620.

Referring back to FIG. 5, first, in operation 500, a fixed codebook vector that minimizes a mean squared error (MSE) of a target signal is searched in each of the first and second spaces 610 and 620 of the fixed codebook of the core layer.

In operation 510, a distorted value D1 of the fixed codebook vector selected from the second space 620 of the fixed codebook of the core layer in the operation 500 is subtracted from a distorted value D0 of the fixed codebook vector selected from the first space 610 of the fixed codebook of the core layer in the operation 500.

In operation 520, it is determined whether a value D0-D1 corresponding to the result of the subtraction in the operation 510 is larger than 0.

In operation 530, if it is determined in the operation 520 that the value D0-D1 is larger than 0, an identifier of the first space 610 of the fixed codebook of the core layer is generated. Here, the identifier represents a specific space provided in the fixed codebook of the core layer as a bit "offset" illustrated in FIGS. 8A and 9A.

After the operation 530, in operation 540, only the second space 620 of the fixed codebook of the enhancement layer is searched for a fixed codebook vector.

In operation 550, if it is determined in the operation 520 that the value D0-D1 is less than or equal to 0, an identifier of the second space 620 of the fixed codebook of the core layer is generated.

In operation 560, only the first space 610 of the fixed codebook of the enhancement layer is searched for a fixed codebook vector.

Figure 10A:
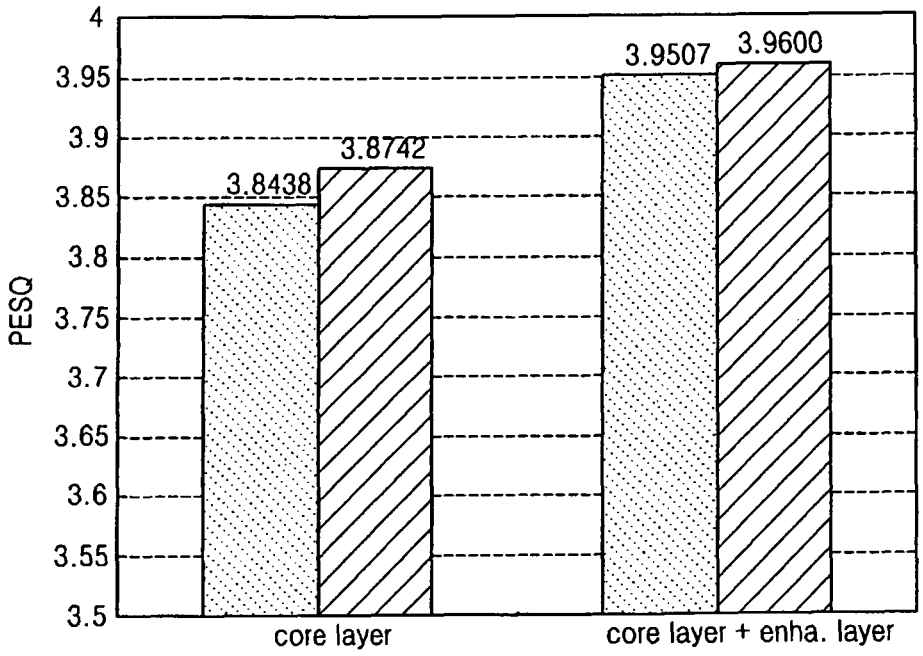
FIG. 10A is a graph illustrating results of a comparison between a PESQ (perception evaluation of speech quality) of an embodiment of the present general inventive concept and the prior art.
Figure 10B:
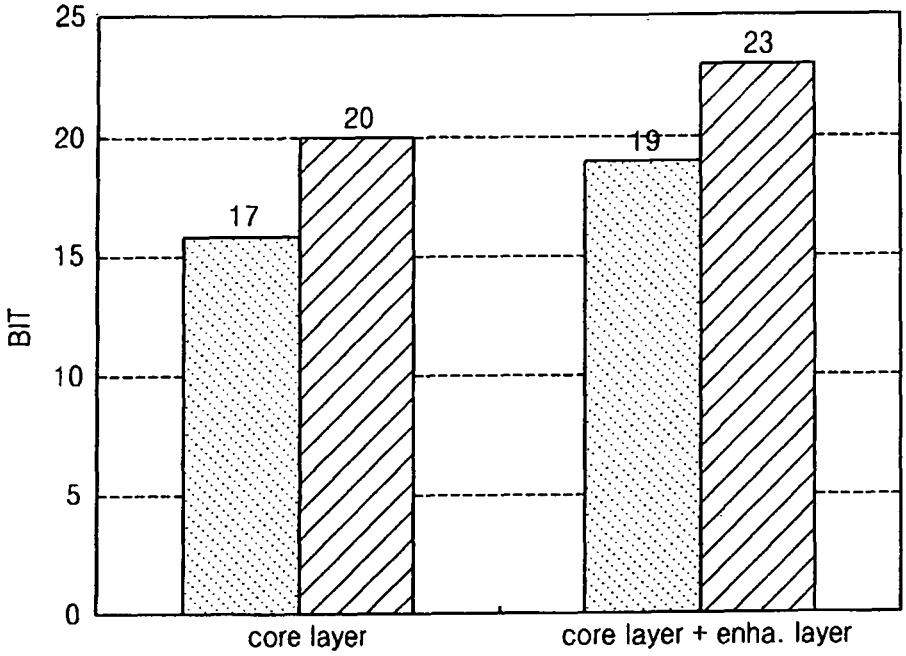
FIG. 10B is a graph illustrating results of a comparison between bits for each sub-frame used in a fixed codebook in an embodiment of the present general inventive concept and those in the prior art.

FIG. 8A illustrates bits allocated to a fixed codebook of a core layer according to an embodiment of the present general inventive concept. FIG. 8B illustrates bits allocated to a fixed codebook of an enhancement layer according to an embodiment of the present general inventive concept. FIG. 8C illustrates bits allocated to a G.729 fixed codebook of a core layer. FIG. 8D illustrates bits allocated to a G.729 fixed codebook of an enhancement layer. FIG. 9A illustrates bits allocated to a fixed codebook of a core layer according to another embodiment of the present general inventive concept. FIG. 9B illustrates bits allocated to a fixed codebook of an enhancement layer according to another embodiment of the present general inventive concept. FIG. 9C illustrates bits allocated to a fixed codebook of a core layer in 3GPP2 VMR-WB rate set-1. FIG. 9D illustrates bits allocated to a fixed codebook of an enhancement layer in 3GPP2 VMR-WB rate set-1. FIG. 10A is a graph illustrating results of a comparison between a PESQ (perceptual evaluation of speech quality) of an embodiment of the present general inventive concept and a PESQ of the prior art. In FIG. 10A, the PESQ(s) of the present embodiment is represented by a dotted bar graph while a PESQ of the prior art is represented by a bar graph having diagonal lines. FIG. 10B is a graph illustrating results of a comparison between bits for each sub-frame used in a fixed codebook in an embodiment of the present general inventive concept and bits for each sub-frame used in a fixed codebook in the prior art. In FIG. 10B, a number of bits of the present embodiment is represented by a dotted bar graph while a number of bits of the prior art is represented by a bar graph having diagonal lines.

In a fixed codebook searching method and apparatus according to embodiments of the present general inventive concept and a speech signal encoding/decoding method and apparatus using the fixed codebook searching method and apparatus, in order to reduce a bit rate without degrading a performance in an enhancement layer based on CELP, each of a fixed codebook of a core layer and a fixed codebook of the enhancement layer is divided into a plurality of spaces. Accordingly, spaces of the fixed codebook of the enhancement layer excluding a space corresponding to the least distorted space determined from among the spaces of the fixed codebook of the core layer are searched.

By doing this, bits for positions values represented with underlining do not need to be allocated to the fixed codebooks of FIGS. 8A, 8B, 9A, and 9B according to the present general inventive concept. Hence, the fixed codebooks of FIGS. 8A, 8B, 9A, and 9B can have a smaller number of bits than the number of bits allocated to the G.729 fixed codebooks illustrated in FIGS. 8C and 8D and the number of bits allocated to the fixed codebooks in 3GPP2 VMR-WB rate set-1 illustrated in FIGS. 9C and 9D. The use of a smaller number of bits in the fixed codebook according to the present general inventive concept can also be seen from the PESQ results illustrated in FIG. 10A and the results of the comparison between bits for each sub-frame used in a fixed codebook in the present general inventive concept and bits for each sub-frame in the prior art illustrated in FIG. 10B. Therefore, in a fixed codebook searching method and apparatus according to embodiments of the present general inventive concept and a speech signal encoding/decoding method and apparatus using the fixed codebook searching method and apparatus, a speech signal can be encoded or decoded using a small number of bits without degrading the performance.

The general inventive concept can be embodied as computer (which denotes any device having an information processing function) readable codes on a computer readable recording medium. The computer readable recording medium is any data storage device that can store programs or data which can be thereafter read by a computer system. Examples of the computer readable recording medium include read-only memory (ROM), random-access memory (RAM), CD-ROMs, magnetic tapes, hard disks, floppy disks, flash memory, optical data storage devices, and so on.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A fixed codebook searching apparatus, comprising:

a core layer codebook including a first space and a second space into which combinations of possible positions of pulses are classified;

a core layer searching unit, implemented by using at least one processing device, to search each of the first and second spaces of the core layer codebook and to determine a least distorted space from among the first and second spaces of the core layer codebook by comparing a distortion value of a first fixed codebook vector selected from the first space with a distortion value of a second fixed codebook vector selected from the second space;

an enhancement layer codebook including a first space and a second space corresponding to the first space and the second space of the core layer codebook, respectively; and an enhancement layer searching unit to search the spaces of the enhancement layer codebook excluding the first space or the second space in the enhancement layer codebook that corresponds to the first space or the second space in the core layer codebook determined to be the least distorted space among the first and second spaces of the core layer codebook, wherein both the first space of the core layer codebook and the first space of the enhancement layer codebook comprise one of even-numbered possible pulse positions and odd-numbered possible pulse positions and both the second space of the core layer codebook and the second space of the enhancement layer codebook comprise the other of the even-numbered possible pulse positions and the odd-numbered possible pulse positions.

2. The fixed codebook searching apparatus of claim 1, wherein each of the core layer codebook and the enhancement layer codebook is configured by classifying combinations of the possible positions of pulses into the first space and the second space.

3. The fixed codebook searching apparatus of claim 2, wherein the first space comprises possible positions of pulses that are highly likely to be searched from the core layer codebook.

4. The fixed codebook searching apparatus of claim 1, wherein the core layer searching unit comprises:

a searcher to search each of the spaces of the core layer codebook;

a space determiner to determine the least distorted space from among the searched spaces; and an identifier generator to generate an identifier indicating the determined space.

5. An apparatus to encode a speech signal, the apparatus comprising:

a core layer codebook including a first space and a second space into which combinations of possible positions of pulses are classified;

a core layer generating unit to search each of the first and second spaces of the core layer codebook and to generate a core layer by determining a least distorted space from among the spaces of the core layer codebook by comparing a distortion value of a first fixed codebook vector selected from the first space with a distortion value of a second fixed codebook vector selected from the second space;

an enhancement layer codebook including a first space and a second space corresponding to the first space and the second space of the core layer codebook, respectively;

an enhancement layer generating unit to generate an enhancement layer by searching the first space and the second space of the enhancement layer codebook excluding the first space or the second space in the enhancement layer codebook that corresponds to the first space or the second space of the core layer codebook determined to be the least distorted space among the first and second spaces of the core layer codebook; and an encoding unit, implemented by using at least one processing device, to encode the speech signal into a core layer and an enhancement layer, wherein both the first space of the core layer codebook and the first space of the enhancement layer codebook comprise one of even-numbered possible pulse positions and odd-numbered possible pulse positions and both the second space of the core layer codebook and the second space of the enhancement layer codebook comprise the other of the even-numbered possible pulse positions and the odd-numbered possible pulse positions.

6. The apparatus of claim 5, wherein each of the core layer codebook and the enhancement layer codebook is configured by classifying combinations of the possible positions of pulses into the first space and the second space.

7. The apparatus of claim 6, wherein the first space comprises possible positions of pulses that are highly likely to be searched from the core layer codebook.

8. The apparatus of claim 5, wherein the core layer generating unit comprises:

a searcher to search each of the spaces of the core layer codebook;

a space determiner to determine a space to which a least distorted result from among results found in the searched spaces;

a layer generator to generate the core layer using the least distorted result found in the determined space; and an identifier generator to generate an identifier indicating the determined space.

9. An encoding apparatus to encode a speech signal, the apparatus comprising:

a core layer generation unit, implemented by using at least one processing device, having a core fixed codebook with a first space and a second space that are searchable for codes to encode a core layer of the speech signal, the first space and the second space being searchable to determine a least distorted space among the first and second spaces of the core Fixed code book by comparing a distortion value of a first fixed codebook vector selected from the first space with a distortion value of a second fixed codebook vector selected from the second space; and an enhancement layer generation unit having an enhancement fixed codebook with a first space and a second space that respectively correspond to the first space and second space of the core fixed codebook, wherein the other of the first space or the second space of the enhancement fixed codebook that corresponds to the first space or the second space of the core fixed codebook determined to be the least distorted space is searchable for codes to encode an enhancement layer of the speech signal, wherein both the first space of the core layer codebook and the first space of the enhancement layer codebook comprise one of even-numbered possible pulse positions and odd-numbered possible pulse positions and both the second space of the core layer codebook and the second space of the enhancement layer codebook comprise the other of the even-numbered possible pulse positions and the odd-numbered possible pulse positions.

10. The apparatus of claim 9, wherein the core fixed codebook and the enhancement fixed codebook each have different encoding information based on where pulses occurring in a sub-frame of a core layer and an enhancement layer of the speech signal are likely to occur.

11. The apparatus of claim 9, wherein different position bits are allocated to each of the core fixed codebook and the enhancement fixed codebook.

12. The apparatus of claim 9, wherein the core fixed codebook and the enhancement fixed codebook are divided into predetermined groups of pulse position bits such that an enhancement layer is encoded using a first group of pulse position bits and a core layer is encoded using a second group of pulse position bits.

13. The apparatus of claim 9, wherein the core layer generation unit searches the core fixed codebook for a first fixed codebook vector that minimizes distortion with respect to a first signal and includes a space indicator to indicate the space of the core fixed codebook in which the codebook vector is found.

14. The apparatus of claim 13, wherein the enhancement layer generation unit searches the enhancement fixed codebook for a second fixed codebook vector in a space of the enhancement fixed codebook that does not correspond to the space indicated by the space indicator.

15. The apparatus of claim 9, wherein the core layer generation unit further includes an adaptive codebook to output an adaptive codebook vector indicative of pitch information of the speech signal.

16. An apparatus to decode a speech signal encoded into a core layer and an enhancement layer, the apparatus comprising:

a core layer codebook including a first space and a second space into which combinations of possible positions of pulses are classified;

a core layer decoding unit, implemented by using at least one processing device, to decode the core layer by searching either the first space or the second space of the core layer codebook that is indicated by an identifier included in the encoded speech signal, the identifier indicating a least distorted space from among the first and second spaces of the core layer codebook, wherein the least distorted space from among the first and second spaces is determined by comparing a distortion value of a first fixed codebook vector selected from the first space with a distortion value of a second fixed codebook vector selected from the second space;

an enhancement layer codebook including a first space and a second space corresponding to the first space and second space of the core layer codebook, respectively; and an enhancement layer decoding unit to decode the enhancement layer by searching the first and second spaces of the enhancement layer codebook excluding the first space or the second space in the enhancement layer codebook that corresponds to the first space or the second space of the core layer codebook determined to be the least distorted space among the first and second spaces of the core layer codebook, wherein both the first space of the core layer codebook and the first space of the enhancement layer codebook comprise one of even-numbered possible pulse positions and odd-numbered possible pulse positions and both the second space of the core layer codebook and the second space of the enhancement layer codebook comprise the other of the even-numbered possible pulse positions and the odd-numbered possible pulse positions.

17. The apparatus of claim 16, wherein the identifier included in the encoded speech signal indicates a space of the core layer codebook that is used to decode the encoded speech signal.

18. The apparatus of claim 16, wherein each of the core layer codebook and the enhancement layer codebook is configured by classifying the combinations of possible positions of pulses into the first space and the second space.

19. The apparatus of claim 18, wherein the first space comprises possible positions of pulses that are highly likely to be searched from the core layer codebook.

20. A decoding apparatus to decode an encoded speech signal, the apparatus comprising:

a core layer decoding unit, implemented by using at least one processing device, having a core fixed codebook with a first space and a second space that are searchable for codes to decode a core layer of the encoded speech signal, the first space and the second space being searchable to determine a least distorted space among the first and second spaces of the core fixed code book by comparing a distortion value of a first fixed codebook vector selected from the first space with a distortion value of a second fixed codebook vector selected from the second space; and an enhancement layer decoding unit having an enhancement fixed codebook with a first space and a second space that respectively correspond to the first space and second space of the core fixed codebook, wherein the other of the first space or the second space of the enhancement fixed codebook that corresponds to the first space or the second space of the core fixed codebook determined to be the least distorted space is searchable for codes to decode an enhancement layer of the encoded speech signal, wherein both the first space of the core layer codebook and the first space of the enhancement layer codebook comprise one of even-numbered possible pulse positions and odd-numbered possible pulse positions and both the second space of the core layer codebook and the second space of the enhancement layer codebook comprise the other of the even-numbered possible pulse positions and the odd-numbered possible pulse positions.

21. A fixed codebook searching method, comprising:

searching a first space and a second space of a core layer codebook;

determining, performed by at least one processor, a least distorted space from among the first and second spaces of the core layer codebook by comparing a distortion value of a first fixed codebook vector selected from the first space with a distortion value of a second fixed codebook vector selected from the second space; and searching a first space and a second space of an enhancement layer codebook excluding the first space or the second space of the enhancement layer codebook respectively corresponding to the first space or the second space of the core layer codebook determined to be the least distorted space among the first and second spaces of the core layer codebook, wherein the core layer codebook is configured by classifying possible pulse positions into the first and second spaces of the core layer codebook, and the enhancement layer codebook is configured by classifying possible pulse positions into the first and second spaces of the enhancement layer codebook corresponding to the first and second spaces of the core layer codebook, respectively, and both the first space of the core layer codebook and the first space of the enhancement layer codebook comprise one of even-numbered possible pulse positions and odd-numbered possible pulse positions and both the second space of the core layer codebook and the second space of the enhancement layer codebook comprise the other of the even-numbered possible pulse positions and the odd-numbered possible pulse positions.

22. The fixed codebook searching method of claim 21, wherein each of the core layer codebook and the enhancement layer codebook is configured by classifying combinations of possible positions of pulses into the first space and the second space.

23. The fixed codebook searching method of claim 22, wherein the first space comprises possible positions of pulses that are highly likely to be searched from the core layer codebook.

24. The fixed codebook searching method of claim 21, wherein the determining of the least distorted space comprises generating an identifier indicating the determined space.

25. A method of searching a fixed codebook, the method comprising:

searching for a fixed codebook vector in first and second spaces of a fixed codebook of a core layer;

comparing, performed by at least one processor, a distortion value of a first fixed codebook vector selected from the first space with a distortion value of a second fixed codebook vector selected from the second space to determine a least distorted space from among the first and second spaces of the fixed codebook of the core layer;

generating an identifier to indicate one of the first and second spaces based on the comparison of the distortion values; and searching one of a first space and a second space of a fixed codebook of an enhancement layer not indicated by the identifier for a fixed codebook vector of the enhancement layer, the first space and the second space of the fixed codebook of the enhancement layer corresponding to the first space and the second space of the fixed codebook of the core layer, wherein both the first space of the core layer codebook and the first space of the enhancement layer codebook comprise one of even-numbered possible pulse positions and odd-numbered possible pulse positions and both the second space of the core layer codebook and the second space of the enhancement layer codebook comprise the other of the even-numbered possible pulse positions and the odd-numbered possible pulse positions.

26. A method of encoding a speech signal, the method comprising:

searching a first space and a second space of a core layer codebook;

generating a core layer by determining a least distorted space from among the first and second spaces of the core layer codebook by comparing a distortion value of a first fixed codebook vector selected from the first space with a distortion value of a second fixed codebook vector selected from the second space;

generating an enhancement layer by searching a first space and a second space of an enhancement layer codebook excluding the first space or the second space of the enhancement layer codebook respectively corresponding to the first space or the second space of the core layer codebook determined to be the least distorted space from among the first and second spaces of the core layer codebook; and encoding, performed by at least one processing device, the speech signal into a core layer and an enhancement layer, wherein the core layer codebook is configured by classifying possible pulse positions into the first and second spaces of the core layer codebook, and the enhancement layer codebook is configured by classifying possible pulse positions into the first and second spaces of the enhancement layer codebook corresponding to the first and second spaces of the core layer codebook, respectively, and both the first space of the core layer codebook and the first space of the enhancement layer codebook comprise one of even-numbered possible pulse positions and odd-numbered possible pulse positions and both the second space of the core layer codebook and the second space of the enhancement layer codebook comprise the other of the even-numbered possible pulse positions and the odd-numbered possible pulse positions.

27. The method of claim 26, wherein each of the core layer codebook and the enhancement layer codebook is configured by classifying combinations of possible positions of pulses into the first space and the second space.

28. The method of claim 27, wherein the first space comprises possible positions of pulses that are highly likely to be searched from the core layer codebook.

29. The method of claim 26, wherein the determining of the least distorted space comprises generating an identifier indicating the determined space.

30. A method of decoding a speech signal encoded into a core layer and an enhancement layer, the method comprising:

decoding, performed by at least one processing device, the core layer by searching either a first space or a second space of a core layer codebook that is indicated by an identifier included in the encoded speech signal, the identifier indicating a least distorted space from among the first and second spaces of the core layer codebook, wherein the least distorted space from among the first and second spaces is determined by comparing a distortion value of a first fixed codebook vector selected from the first space with a distortion value of a second fixed codebook vector selected from the second space; and decoding the enhancement layer by searching a first space and a second space of an enhancement layer codebook excluding the first space or the second space in the enhancement layer codebook corresponding to the first space or the second space of the core layer codebook determined to be the least distorted space among the first and second spaces of the core layer codebook, wherein the core layer codebook is configured by classifying possible pulse positions into the first and second spaces of the core layer codebook, and the enhancement layer codebook is configured by classifying possible pulse positions into the first and second spaces of the enhancement layer codebook corresponding to the first and second spaces of the core layer codebook, respectively, and both the first space of the core layer codebook and the first space of the enhancement layer codebook comprise one of even-numbered possible pulse positions and odd-numbered possible pulse positions and both the second space of the core layer codebook and the second space of the enhancement layer codebook comprise the other of the even-numbered possible pulse positions and the odd-numbered possible pulse positions.

31. The method of claim 30, wherein the identifier included in the encoded speech signal indicates a space of the core layer codebook that is used to decode the encoded speech signal.

32. The method of claim 30, wherein each of the core layer codebook and the enhancement layer codebook is configured by classifying combinations of possible positions of pulses into the first space and the second space.

33. The method of claim 32, wherein the first space comprises possible positions of pulses that are highly likely to be searched from the core layer codebook.

34. A non-transitory computer readable recording medium that records a computer program for executing a fixed codebook searching method, comprising:

executable code to search a first space and a second space of a core layer codebook;

executable code to determine a least distorted space from among the first and second spaces of the core layer codebook by comparing a distortion value of a first fixed codebook vector selected from the first space with a distortion value of a second fixed codebook vector selected from the second space; and executable code to search a first space and a second space of an enhancement layer codebook excluding the first space or the second space of the enhancement layer codebook respectively corresponding to the first space or the second space of the core layer codebook determined to be the least distorted space among the first and second spaces of the core layer codebook, wherein the core layer codebook is configured by classifying possible pulse positions into the first and second spaces of the core layer codebook, and the enhancement layer codebook is configured by classifying possible pulse positions into the first and second spaces of the enhancement layer codebook corresponding to the first and second spaces of the core layer codebook, respectively, and both the first space of the core layer codebook and the first space of the enhancement layer codebook comprise one of even-numbered possible pulse positions and odd-numbered possible pulse positions and both the second space of the core layer codebook and the second space of the enhancement layer codebook comprise the other of the even-numbered possible pulse positions and the odd-numbered possible pulse positions.

* * * * *